United States Patent [19]

Souza, Jr.

[11] 4,050,203

[45] Sept. 27, 1977

[54] STAIRS AND RAILING SYSTEM FOR MULTI-FLOORED BUILDINGS AND METHOD OF CONSTRUCTING SAME

[76] Inventor: Thomas Souza, Jr., P.O. Box 579, 145 Hekili St., Kailua, Hawaii 96734

[21] Appl. No.: 701,631

[22] Filed: July 1, 1976

Related U.S. Application Data

[62] Division of Ser. No. 646,762, Jan. 6, 1976, Pat. No. 3,994,113.

[51] Int. Cl.[2] ..... E04F 11/00; E04F 11/18

[52] U.S. Cl. ..... 52/185

[58] Field of Search ..... 52/182, 184, 185, 189, 52/183, 186, 187, 188; 256/65

[56] References Cited

U.S. PATENT DOCUMENTS

| | | | |
|---|---|---|---|
| 1,248,141 | 11/1917 | Lieberman | 52/184 |
| 3,981,112 | 9/1976 | Dake | 52/189 |

FOREIGN PATENT DOCUMENTS

| | | | |
|---|---|---|---|
| 289,007 | 6/1953 | Switzerland | 52/184 |

*Primary Examiner*—John E. Murtagh

[57] ABSTRACT

A stairs and method of constructing same is disclosed for multifloored buildings having walled stairwells. Each run of stairs comprises parallel spaced apart stringers having horizontally extending ends for mounting platform members and a plurality of spaced apart risers secured to the stringers intermediate the ends for supporting tread members. The platform and tread members are made of reinforced concrete and contain threaded inserts to receive bolts for mounting them to the stringer ends and risers. A parallel set of stringers are temporarily supported in position prior to the construction of and being secured to the walls of the stairwell by jacks or the like positioned between platforms positioned on the ends of the stringers and the underside of the ends of an adjacent set of stringers.

10 Claims, 18 Drawing Figures

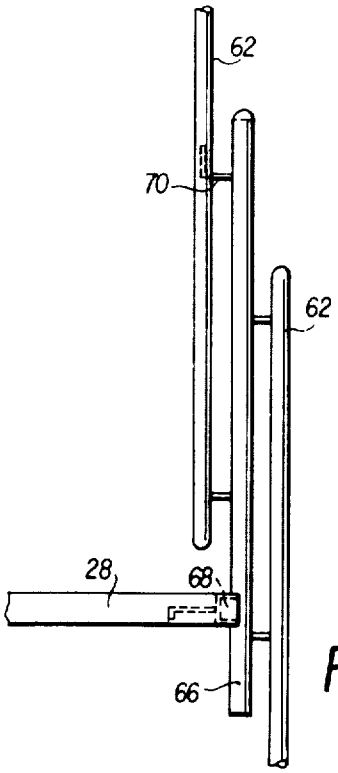
FIG. 13
FIG. 12
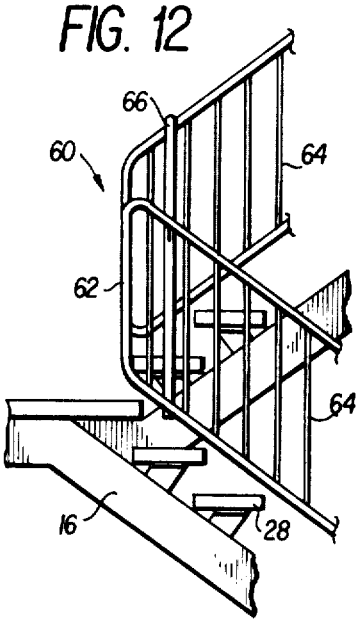
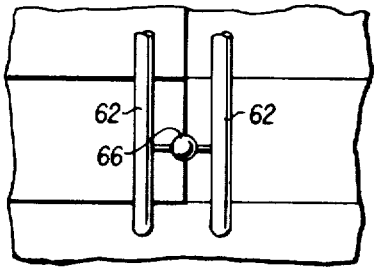
FIG. 14
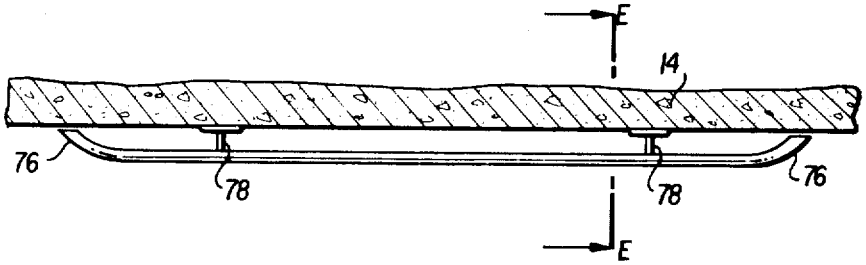
FIG. 15

STAIRS AND RAILING SYSTEM FOR MULTI-FLOORED BUILDINGS AND METHOD OF CONSTRUCTING SAME

This is a division of application Ser. No. 646,762, filed Jan. 6, 1976, now U.S. Pat. No. 3,994,113.

FIELD OF THE INVENTION

This invention relates generally to staircases and, more particularly, to stairs constructed of previously unassembled, prefabricated elements including stringers, platforms, treads and railings and the method of erecting same.

BACKGROUND OF THE INVENTION

Presently, it is normal construction practice to either erect the walls of stairwells, install landing platforms as the walls go up and then construct the stairs after the walls have been completed or to construct complete sections of stairs at some remote location, transport them to the job site and building the walls of the stairwells around the completed stacked sections.

The former practice has the serious disadvantage that extensive temporary scaffolding has to be erected together with safety rails and ladders for the construction workers. Each run of stairs is, thus, a custom job adding greatly to the cost of the stairs. In the latter practice, the prefabricated stair sections require extensive metal bracing to support the stairs until the walls are formed therearound. After the walls are completed, the bracing is permitted to remain in the walls of the staircase. This bracing constitutes a substantial and unnecessary waste in that the ultimate support for the finished stairs results not from the bracing but from the connection of the stairs to the walls of the stairwell. Further, the bracing is normally located at the outer extremities of the sections which masonry workers find interferes with the construction of the stairwells. In addition, the prefabricated stair sections are rather unwieldy structures which are difficult to transport economically and align properly in stacked relationship to each other.

It is therefore an object of this invention to provide a unique stairs for multi-floored buildings and its method of construction and erection which has definite advantages over former stairs and their construction methods while doing away with their disadvantages.

It is a further object of this invention to provide a stairs and method of constructing same comprising elements which can be easily assembled on the job site after they are prefabricated on the job site or at a remote location.

It is a still further object of this invention to provide a stairs and method of constructing same wherein the stairs are constructed prior to erection of the walls of a stairwell and the supports for the stairs are contained within the extremities of the stairs and are removed for reuse after the stairs are secured to the stairwell walls.

It is yet a further object to provide a stairs and method of constructing same wherein the platform members of preceding sections of stairs serve as a base for mounting the removable supports for additional levels of stairs.

It is another object of the present invention to provide a substantially continuous railing system for multi-floored buildings.

Other objects and advantages will be pointed out in, or be apparent from, the specification and claims, as will obvious modifications of the embodiments shown in the drawings.

BRIEF DESCRIPTION OF DRAWINGS

In the drawings:

FIG. 12 is a partial enlarged elevational view of the railing of the instant invention and the mounting means therefor.

FIG. 13 is an end view of the railing shown in FIG. 12.

FIG. 14 is a partial plan view of the railing shown in FIG. 12.

FIG. 15 is a plan view of the wall mounted railing of the instant invention.

DESCRIPTION OF PREFERRED EMBODIMENTS

Figure 1:
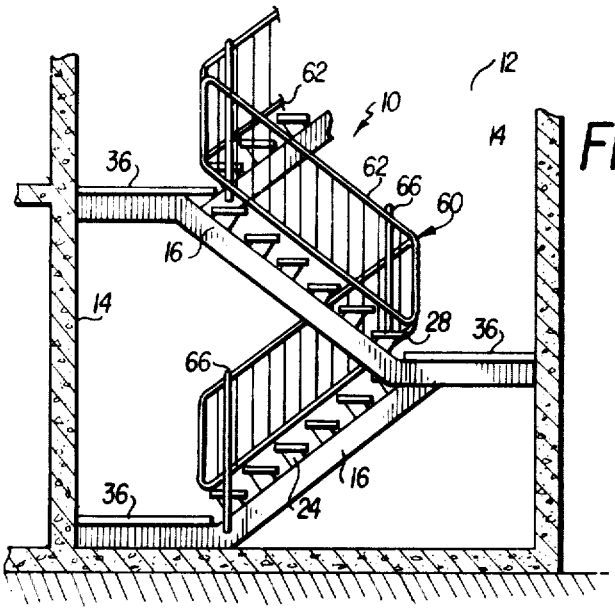
FIG. 1 is an elevational view of the completed stairs of the instant invention extending from the first floor of a building to the second floor.
Figure 2:
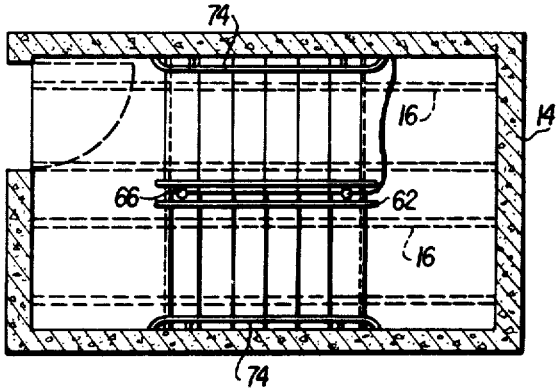
FIG. 2 is a plan view of the completed stairs shown in FIG. 1.
Figure 3:
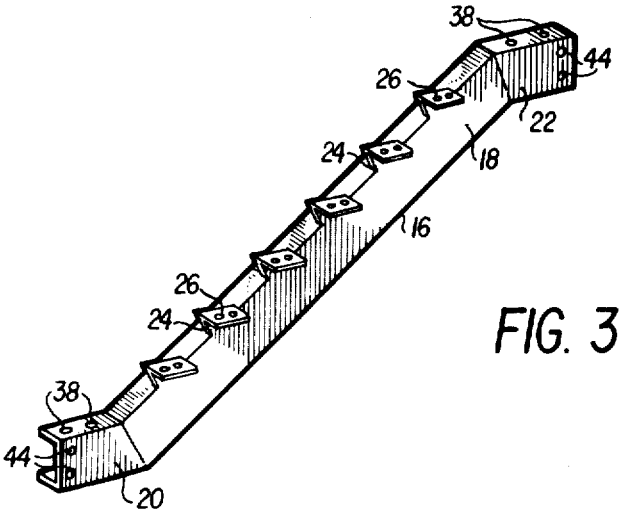
FIG. 3 is a perspective view of a stringer of the instant invention.
Figure 4:
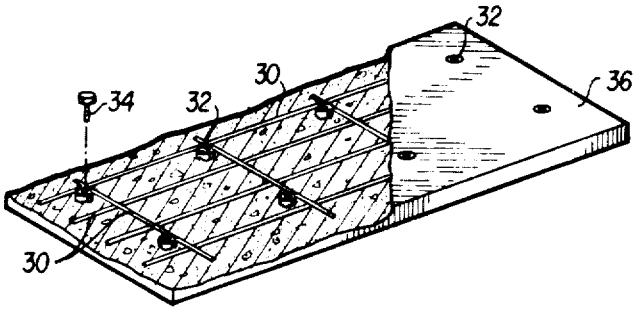
FIG. 4 is a perspective view of a platform member of the instant invention.
Figure 5:
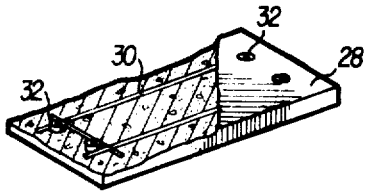
FIG. 5 is a perspective view of a tread member of the instant invention.

Referring to the drawings where like characters of reference indicate similar elements in each of the several views, in FIGS. 1 - 5 there is shown generally at 10 the base stair unit of the instant invention and some of the elements which comprise it. The stair unit 10 was erected by the method to be more fully described later and is contained in a stairwell 12 having walls 14.

The stair unit 10 comprises two sets of two parallel, spaced apart stringers 16 each. Each stringer 16 is a channel of steel substantially U-shaped in cross-section having a middle section 18 and end sections 20, 22. The middle section 18 has a plurality of spaced apart substantially L-shaped risers 24 welded to the outer, upper edge thereof. The risers 24 have one or more holes 26 through the uppermost side thereof and are made of a gauge of steel plate that can be relatively easily bent by a hammer blow for a purpose that will be later explained. A plurality of tread members or steps 28 are provided which rest on the risers 24. The treads 28 are fabricated out of concrete which is cast in a form (not shown) located on the job site or at a remote location. If the forms are located on the job site, excess concrete not used at the end of the day on building construction can be poured into the forms to make the treads for the following day's use. The treads 28 have rods of reinforcing steel 30 embedded therein as well as two threaded inserts 32 located adjacent each side thereof which are also embedded in the concrete. After the treads 28 have been placed on the risers 24, bolts 34 are inserted through holes 26 and tightened into the threaded inserts 32 to hold the treads to the risers.

A plurality of platforms 36 are also provided which are made in forms (not shown) as described hereinabove with respect to the treads 28. The platforms 36 also have reinforcing steel rods 30 embedded therein and spaced apart, threaded inserts 32, the spacing of which corresponds to holes 38 in end sections 20, 22. The platforms 36 are also secured to the end sections 20, 22 by bolts 34 tightened into the inserts 32.

Figure 6:
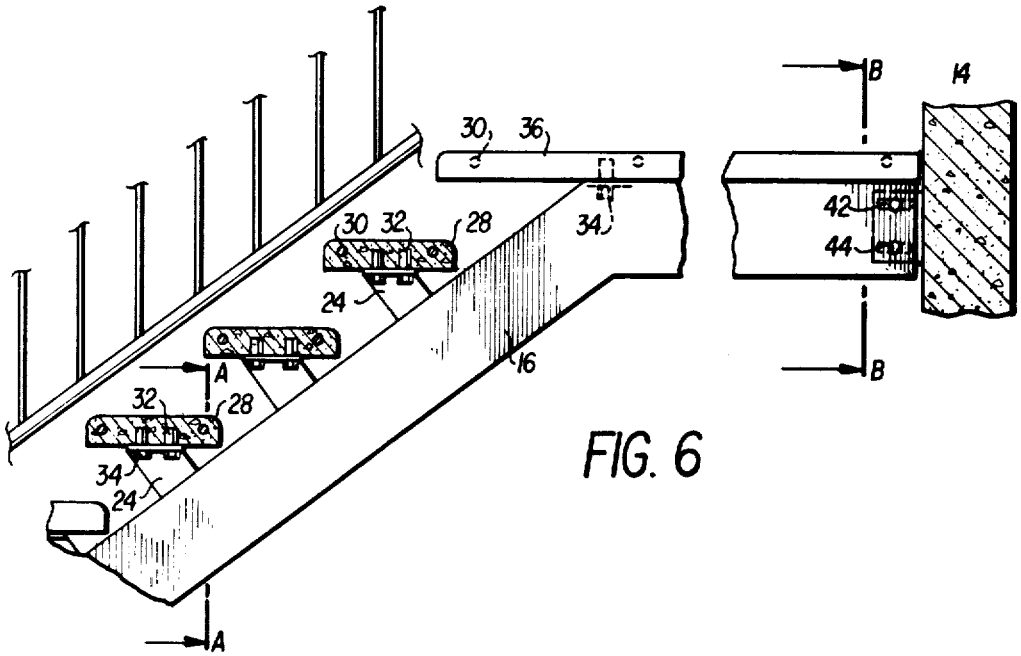
FIG. 6 is an enlarged side elevation view in partial cross-section of one embodiment of the risers and wall connection employed in the instant invention.
Figure 7:
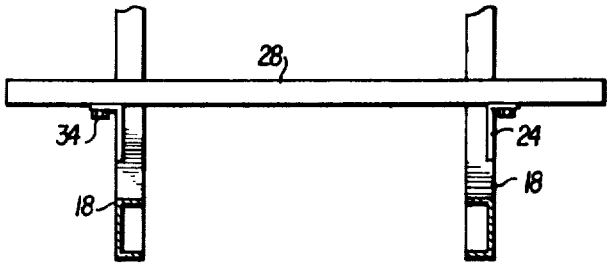
FIG. 7 is a view taken along the lines A—A of FIG. 6.
Figure 8:
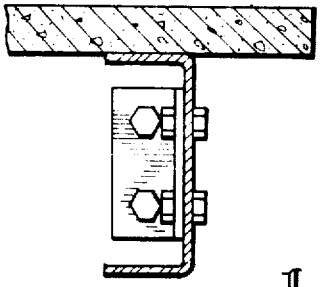
FIG. 8 is a view taken along the lines B—B of FIG. 6.

Referring now to FIGS. 6, 7 and 8, the treads 28 are shown bolted to the risers 24 and a platform 36 is shown bolted to an upper end section 22 of the stringer 16. The upper end sections 22, in one embodiment, are secured to the stairwell walls 14 by means of a L-shaped bracket 40. The bracket 40 has slotted bolt holes 42 which align with bolt holes 44 in the ends of sections 20, 22. Holes 46 in bracket 40 enable the bracket to be bolted to the stairwell wall 14 by conventional means. By slotting bolt holes 42, adjustment of the stringer 16 relative to wall 14 can easily be made. When headroom is ample, the width of the stringer channel 16 is eight inches and the risers 24 are welded to the upper outer edge of the channel as shown in FIG. 6.

Figure 9:
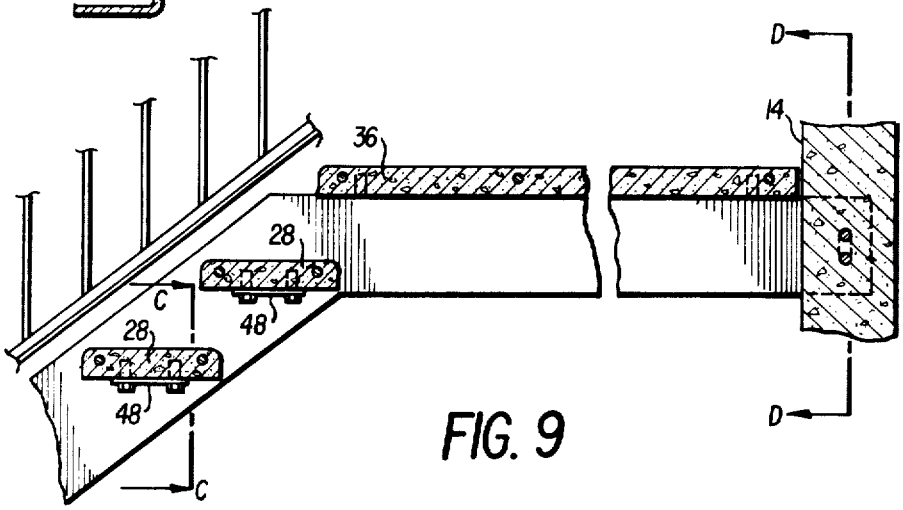
FIG. 9 is an enlarged side elevation view in partial cross-section of another embodiment of the risers and wall connection employed in the instant invention.
Figure 10:
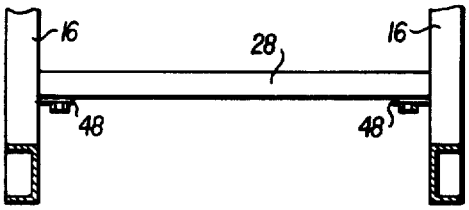
FIG. 10 is a view taken along the lines C—C of FIG. 9.
Figure 11:
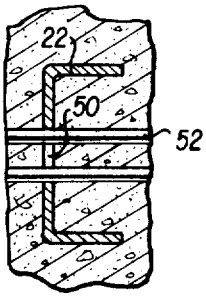
FIG. 11 is a view taken along the lines D—D of FIG. 9.

However, if headroom is minimal, the embodiment shown in FIGS. 9, 10 and 11 is used. The width of the stringer channel 16 is increased to ten inches and the risers 48 consist of a flat plate of metal which are welded to the outside surface of the intermediate portion of the channel as best shown in FIG. 10. The treads 28 are then bolted to the risers 48 in the same manner as previously described with regard to risers 24. In this embodiment, the ends of the end sections 20, 22 have slotted holes 50 through which is passed sections of reinforcing steel rods 52. A portion of the end sections 20, 22 are then embedded in the stairwell wall 14 as it is formed and the steel rods 52 prevent the ends 20, 22 from being withdrawn.

FIGS. 1, 12, 13 and 14 disclose applicant's novel railing system generally at 60. Unlike conventional railing systems which normally consist of a continuous run of the top railing requiring extensive on-site fitting on the stairway, applicant employs a plurality of sections 62 which are panelized. The panel is formed of 1 inch diameter pipe in the shape of a parallelogram with rounded corners. A plurality of pickets 64 are located between the upper and lower sections of the panel to give it structural rigidity. In order to mount the panel 62 relative to the stairs, posts 66 are provided. The posts 66 are secured to mounting elements 68 by welding or the like. The mounting elements 68 are embedded in two treads 28 which are in turn mounted on each section of parallel stringers 16 in spaced apart relationship. Substantially L-shaped brackets 70 are also provided, one end of which is welded to the post 66 and the other end of which is welded to the underside of the top rail of panel 62 as can be seen in FIGS. 13 and 14. Thus, by arranging the panels 62 as shown in FIGS. 1 and 12, a continuous railing is provided as required by the building codes of most jurisdictions with no protrusions to catch clothing and one which is easily mounted on the stairs by semi-skilled workman with no intricate fitting required.

Figure 16:
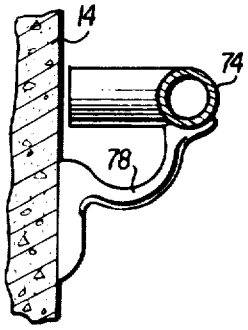
FIG. 16 is an enlarged end view of the railing of FIG. 15 taken along lines E—E thereof.

FIGS. 15 and 16 disclose another part of applicant's unique railing system, the hand rail. The hand rail comprises a length of pipe 74, the ends 76 of which are gradually bent inwardly toward the stairwell wall 14. The building codes of most jurisdictions require that the ends of wall mounted hand rails be terminated adjacent the side of the wall to which they are attached to prevent clothing, etc. from being caught thereby. Heretofore, separate pipe elbows were attached to the ends of the railings and pointed inwardly toward the wall resulting in added expense in material and labor. Applicant has eliminated this added expense by merely bending the ends gradually toward the wall. Brackets 78 are also provided for mounting the railing 74 to the wall 14.

METHOD OF CONSTRUCTION

Applicant's novel method of constructing the stairs previously disclosed will not be described in detail. Applicant's method enables the stairs to be constructed prior to the construction of the stairwell 14.

Figure 18:
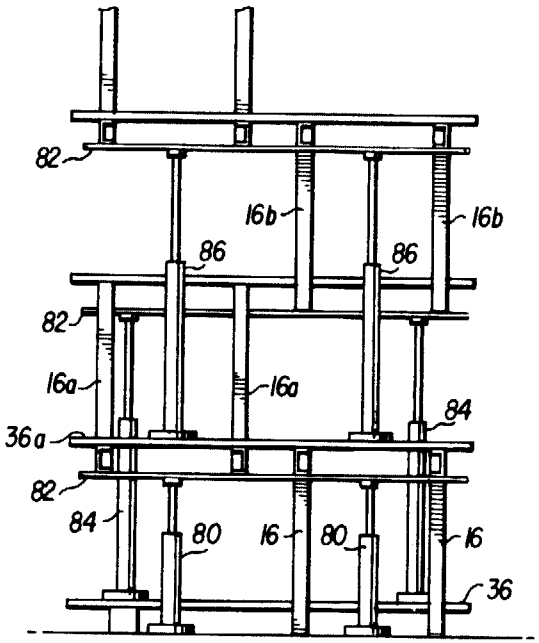
FIG. 18 is an end view of the stairs shown in FIG. 17.
Figure 17:
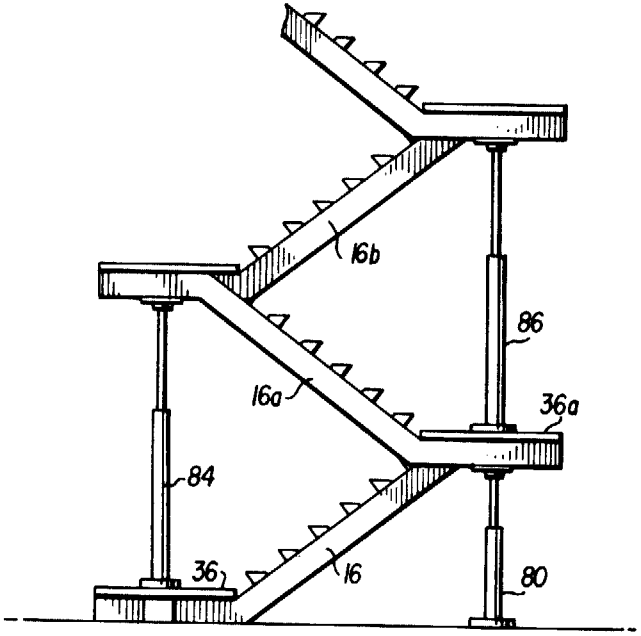
FIG. 17 is an elevational view of the stairs of the instant invention with temporary supports in place.

Referring to FIGS. 17 and 18, pair of stringers 16 is first positioned in parallel, spaced apart relationship to each other with the lower end section 20 resting on the building floor. The upper end section 22 is temporarily supported in its elevated state by a first set of jacks, stays or other supporting structure 80. The jacks 80 are positioned between the building floor and the underside of upper end section 22 of each stringer 16 and a plate 82 can be used to space both of said upper end sections 22.

A platform 36 is then positioned on lower end section 20. A second set of parallel, spaced apart stringers 16a are then positioned adjacent the first set such that the lower end sections 20 are also supported by the first set of jacks 80. The upper end section 22 of the second set of stringers **16*a* are then maintained in their elevated position by means of a second set of jacks 84. The second set of jacks 84 are positioned between the top of platform 36 and the underside of upper end sections 22 of the second set of stringers 16*a*. The platform 36 can be temporarily inverted so that the threaded inserts 32 face the jacks 84 so that the jacks 84 can be bolted to the platform 36** if desired.

In like manner, a third set of parallel, spaced apart stringers **16*b* can be arranged so that the lower end sections 20 thereof are supported by jacks 84 and the upper end sections 22 thereof are supported by jacks 86 arranged between a platform 36*a* and the underside of the upper end section 22**.

As the walls 14 of the stairwell 12 are constructed around the standing stairs and the lower and upper end sections 20, 22 are secured to the walls 14, the jacks 80, 84 etc. can be removed and the treads 28 and railings 62 installed. Additional levels of stairs are added as required by repeating the aforedescribed series of procedural steps. If the holes 26 in the risers 24 do not align themselves properly with the inserts 32, a slight blow with a hammer or the like will quickly bring them into alignment so the bolts 34 can be inserted.

Applicant has thus described his novel stairs for multi-floored buildings and the like and the method of erecting same. By using elements such as the treads 28 and platform 36 which can be prefabricated in forms on the job site and prefabricated stringers 16 as disclosed, the stairs can be quickly and economically erected by the method disclosed using temporary jacks or other devices normally found on construction sites. Because all supporting structures such as the jacks are removed after the stringer end sections are attached to the walls of the stairwells, substantial savings are again realized. In addition, because the stairs at each level can be quickly completed, they become immediately available for use by workmen.

It will be obvious to those skilled in the art that various changes may be made without departing from the spirit of the invention and, therefore, the invention is not limited to what is shown in the drawings and described in the specification but only as indicated in the appended claims.

What is claimed is:

1. A stairs for multi-floored buildings having a walled stairwell, said stairs comprising:

1. a first set of parallel, spaced apart stringers having platform mounting means integrally formed with and extending a distance from each end thereof;
2. a second set of parallel, spaced apart stringers also having platform mounting means integrally formed with and extending a distance from each end thereof, said second set of stringers being positioned adjacent said first set and extending opposite thereto, said first and second set of stringers each having spaced apart tread mounting means secured to said stringers intermediate said platform mounting means;
3. a platform member having four sets of spaced apart threaded inserts formed integrally therewith, said platform being secured to said platform mounting means on said first set of stringers by bolts extending through said platform mounting means and tightened into two of said four set of inserts and said platform being secured to said platform mounting means on said second set of stringers by bolts extending through said platform mounting means and tightened into the remaining two of said four platform mounting means and tightened into the remaining two of said four sets of inserts; and
4. a plurality of tread members having at least two spaced apart threaded inserts formed integrally therewith, said tread members being secured to said tread mounting means by bolts extending through said tread mounting means and tightened into said inserts.

2. A stairs as set forth in claim 1 wherein said stringers are channel members substantially U-shaped in cross-section with parallel extending legs and a middle portion connecting said legs and said tread mounting means are risers secured to said channel members.

3. A stairs as set forth in claim 16 wherein said risers are secured to one of said legs of said U-shaped channel members.

4. A stairs as set forth in claim 16 wherein said risers are secured to said middle portion connecting said legs of said U-shaped channel members.

5. A stairs as set forth in claim 16 wherein said risers have at least one hole therein and are made of a relatively easily deformable material to permit alignment of said holes with said threaded inserts.

6. A stairs as set forth in claim 1 wherein said platform members and said tread members are made of precast, steel reinforced, cementatious material.

7. A stairs as set forth in claim 1 wherein at least two of said stairs have a railing mounting means integrally formed therewith and at one end thereof and said stairs further comprises:

1. parallel, spaced apart post means secured to said railing mounting means; and
2. continuous railing means secured to said post means, said railing means having two sides which are parallel to said stringer.

8. A stairs as set forth in claim 7 wherein said railing means is in the shape of a parallelogram having a plurality of picket means extending between either set of parallel sides of said parallelogram to increase the structural rigidity of said railing.

9. A stairs as set forth in claim 1 wherein said stairs further comprises a railing means mounted on a wall of said stairwell in parallel, spaced apart relationship to said stringers.

10. A stairs as set forth in claim 9 wherein said railing has ends which are bent inwardly toward said wall of said stairwell.

* * * * *